US008863564B2

(12) United States Patent
Shimoda et al.

(10) Patent No.: US 8,863,564 B2
(45) Date of Patent: Oct. 21, 2014

(54) LUBRICANT COMPOSITION FOR HOT METAL WORKING AND METHOD OF HOT METAL WORKING USING THE SAME

(75) Inventors: Kazuhiro Shimoda, Osaka (JP); Tomio Yamakawa, Osaka (JP); Kazutaka Asabe, Osaka (JP); Hirokazu Okada, Osaka (JP); Yasuyoshi Hidaka, Osaka (JP); Sumio Iida, Osaka (JP); Naoya Hirase, Osaka (JP); Kenji Takeuchi, Aichi (JP); Shuichi Akiyama, Osaka (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 995 days.

(21) Appl. No.: 12/296,518

(22) PCT Filed: Mar. 29, 2007

(86) PCT No.: PCT/JP2007/056886

§ 371 (c)(1),
(2), (4) Date: Apr. 15, 2009

(87) PCT Pub. No.: WO2007/122972

PCT Pub. Date: Nov. 1, 2007

(65) Prior Publication Data

US 2009/0301151 A1 Dec. 10, 2009

(30) Foreign Application Priority Data

Apr. 24, 2006 (JP) ..... 2006-119270

(51) Int. Cl.
*B21B 45/02* (2006.01)
*C10M 173/02* (2006.01)

(Continued)

(52) U.S. Cl.
CPC ..... *C10M 173/02* (2013.01); *B21B 19/04* (2013.01); *B21B 25/04* (2013.01);

(Continued)

(58) Field of Classification Search
CPC ..... C10N 2210/02; C10N 2210/01; C10N 2220/022; C10N 2230/06; C10M 2203/1025; C10M 2209/104; C10M 173/02; C10M 2209/105; C10M 2209/108
USPC ..... 72/39, 41, 42; 508/110–154; 501/15–17; 173/2; 427/375, 376.1, 427/376.2, 376.3, 376.4, 376.5, 376.6, 427/376.7, 376.8; 428/469–472.2, 428/433–434; 29/458
See application file for complete search history.

(56) References Cited

U.S. PATENT DOCUMENTS 1,970,067 A * 8/1934 Wallmann et al. ..... 75/520
1,992,039 A * 2/1935 Reinhardt ..... 148/111

(Continued)

FOREIGN PATENT DOCUMENTS

EP 0468278 1/1992
EP 2002903 A2 * 12/2008 ..... B21B 17/02

(Continued)

OTHER PUBLICATIONS

Alexander Fluegel, Glass viscosity calculation based on a global statistical modling approach, Feb. 17, 2007, Glass Technol,: Eur.Sci. Technol, A, 48 (1), 13 -30.*

(Continued)

*Primary Examiner* — Shelley Self
*Assistant Examiner* — Lawrence Averick
(74) *Attorney, Agent, or Firm* — Marshall, Gerstein & Borun LLP

(57) ABSTRACT

The present invention provides a lubricant composition for hot metal working which is capable of inhibiting generation of flaws on the surface of materials to be provided for hot metal working, and provides a method of hot metal working. The invention provides a lubricant composition for hot metal working comprising a plurality of glass frits respectively having different softening point from each other.

3 Claims, 2 Drawing Sheets

(51) Int. Cl.

| | |
|---|---|
| *B21D 3/04* | (2006.01) |
| *B23P 25/00* | (2006.01) |
| *B32B 15/00* | (2006.01) |
| *B32B 9/00* | (2006.01) |
| *B21B 19/04* | (2006.01) |
| *B21B 25/04* | (2006.01) |

(52) U.S. Cl.

CPC ..... *C10M 2201/041* (2013.01); *C10M 2201/05* (2013.01); *C10M 2201/062* (2013.01); *C10M 2201/103* (2013.01); *C10M 2201/12* (2013.01); *C10N 2220/022* (2013.01); *C10N 2230/06* (2013.01); *C10N 2240/403* (2013.01); *C10N 2240/404* (2013.01); *C10N 2240/409* (2013.01); *C10N 2250/121* (2013.01)

USPC ..... 72/42; 72/97; 29/458; 428/433; 428/469

(56) References Cited

U.S. PATENT DOCUMENTS

| | | | | | |
|---|---|---|---|---|---|
| 2,105,968 | A | * | 1/1938 | Castle | 72/201 |
| 2,430,083 | A | * | 11/1947 | Sherman | 29/424 |
| 2,461,841 | A | * | 2/1949 | Nordberg | 28/167 |
| 2,674,557 | A | * | 4/1954 | Boggs | 156/184 |
| RE24,017 | E | * | 6/1955 | Henricks | 428/470 |
| 2,731,145 | A | * | 1/1956 | Kritscher | 72/42 |
| 3,254,401 | A | * | 6/1966 | Grego et al. | 29/423 |
| 3,295,346 | A | * | 1/1967 | Bomberger, Jr. | 72/41 |
| 3,345,842 | A | * | 10/1967 | Richards | 72/42 |
| 3,357,220 | A | * | 12/1967 | Grego et al. | 72/42 |
| 3,374,650 | A | * | 3/1968 | Calmes | 72/46 |
| 3,472,050 | A | * | 10/1969 | Gulyaev et al. | 72/42 |
| 3,604,238 | A | * | 9/1971 | Asari | 72/206 |
| 3,872,704 | A | * | 3/1975 | Ohya et al. | 72/364 |
| 4,052,323 | A | * | 10/1977 | Feneberger et al. | 508/118 |
| 4,281,528 | A | * | 8/1981 | Spiegelberg et al. | 72/46 |
| 4,565,664 | A | * | 1/1986 | Ikehata et al. | 264/130 |
| 5,242,506 | A | * | 9/1993 | Barber et al. | 148/22 |
| 5,691,282 | A | | 11/1997 | Periard et al. | |
| 6,210,806 | B1 | * | 4/2001 | Hidaka et al. | 428/469 |
| 6,988,387 | B2 | * | 1/2006 | Nakaike et al. | 72/97 |
| 8,263,534 | B2 | * | 9/2012 | Hori et al. | 508/154 |
| 8,455,408 | B2 | * | 6/2013 | Hori et al. | 508/154 |
| 2008/0229796 | A1 | * | 9/2008 | Stork | 72/47 |
| 2010/0071431 | A1 | * | 3/2010 | Kato et al. | 72/41 |
| 2010/0206037 | A1 | * | 8/2010 | Yagi et al. | 72/343 |

FOREIGN PATENT DOCUMENTS

| | | | | |
|---|---|---|---|---|
| JP | 60-184410 | | 9/1985 | |
| JP | 7-45056 | | 5/1995 | |
| JP | 07-118687 | | 5/1995 | |
| JP | 08-311479 | | 11/1996 | |
| JP | 09-271811 | | 10/1997 | |
| JP | 2003-113387 | | 4/2003 | |
| WO | WO-92/07050 | | 4/1992 | |
| WO | WO 2007114041 | A1 * | 10/2007 | B21B 17/02 |
| WO | WO 2007126005 | A1 * | 11/2007 | |

OTHER PUBLICATIONS

Pavel Hrma, High-Temperature Viscocity of Commercial Glasses, Dec. 12, 2005, Pacific Northwest National Laboratory, original, 57-124.*

Geiss & Knickerbocker, Viscoisity of MgO—Al(2)O(3)-SiO(2)-B(2)O(3)-P(2)O(5 cordierite-type glasses,Oct. 29, 1985,Journel of Material Science Letters, 4 (1985), 835-837.*

International Search Report in corresponding PCT/JP2007/056886 dated May 29, 2007.

Chinese Office Action for Application No. 200780013860.7, dated Jun. 13, 2011.

* cited by examiner

LUBRICANT COMPOSITION FOR HOT METAL WORKING AND METHOD OF HOT METAL WORKING USING THE SAME

TECHNICAL FIELD

The present invention relates to a lubricant composition suitably used for hot metal working in, for example, Mannesmann pipe/tube production line (hereinafter, referred to "pipe" as "pipe/tube").

BACKGROUND ART

Recent soaring crude oil prices economically allows development of deep oil well or wells which produces oil with the inferior quality such as sour crude. As a material of the oil well tubular used for drilling these oil wells, it is demanded that a stainless steel and/or a high-alloy steel these of which have higher mechanical strength than a normal carbon steel and/or have an excellent corrosion resistance to acidic component. Therefore, not only in the conventional extrusion working but also in Mannesmann pipe production, seamless pipe production using the stainless steel and the high-alloy steel is demanded.

However, compared with extrusion working such as Eugene pipe production method, Mannesmann pipe production method severely deforms the material, which results in generation of Mannesmann-specific flaws on the inner and outer surface of the pipe product. Especially, the outer surface flaws generated during the piercing-rolling step is one of the major causes of reduction of productivity. The outer surface flaw can be categorized into the following two types depending on the way of generation.

The first type of the flaw is the one which cannot be removed even by certain treatment (hereinafter, referred to as "flaw which cannot be removed"), it is caused by seizure between disk guides and a billet. It should be noted that the disk guide is classified with a fixed "disk shoe" and a "disk roll" which rotates itself while restraining outer circumference of the billet to de-escalate relative velocity to the billet surface. Below, the description will be given based on a method using "disk roll" as disk guides.

The above flaw which cannot be removed is called "disk mark", it is caused not only on the surface of stainless steel and of high-alloy steel but also on the surface of carbon steel depending on the piercing-rolling condition. As a countermeasure of disk mark, a method for coating anti-seizure agent on a billet like stainless steel before heating or a method for coating a lubricant on the concave surface of the disk rolls are proposed.

As one of the examples of the above art, Patent document 1 discloses a lubricant for hot pipe rolling, in which 2 to 100 parts by mass of one or two kinds of $Al_2O_3$ and MgO as well as 2 to 10 parts by mass of $SiO_2$ are mixed to 100 parts by mass of iron oxide. In addition, it shows that a binder is preferably mixed such that viscosity of the lubricant at room temperature be 8000 centipoise or less.

Moreover, Patent document 2 discloses a method for inhibiting guide shoe flaws generated during hot pipe rolling characterized in the steps of coating a lubricant on the outer surface of a billet in advance, and feeding the billet into a rolling mill having guide shoes.

The second type of flaw is the one which is removable by certain treatment; the flaw is generated, for example, when a material having low-deformability at high temperature such as stainless steel and high-alloy steel is worked. Majority of the flaws have a depth of less than 1 mm. Nevertheless, the flaws are generated all over the outer surface of the material, therefore removal of the flaws require enormous manpower. As a measure for inhibiting the flaws, a method is disclosed, only in Patent document 3, for keeping the temperature of material surface as high as possible by stoppage of roll cooling water, and so on.

Patent Document 1: Japanese Patent Application Examined No. 7-45056

Patent Document 2: Japanese Patent Application Laid-Open (JP-A) No. 60-184410

Patent Document 3: JP-A No. 9-271811 (particularly, paragraphs [0064] to [0068])

DISCLOSURE OF THE INVENTION

Problems to be solved by the Invention

However, it is difficult for the arts shown in the above Patent documents 1 to 3 so as to completely inhibit the generation of removable flaws. These arts demand some sorts of flaw-removing operation after pipe production so that cost for removing operation is emerged, which is problematic.

Accordingly, an object of the present invention is to provide a lubricant composition for hot metal working which is capable of inhibiting generation of flaws on the surface of worked material during hot metal working and to provide a method of hot metal working using the same.

Means for Solving the Problems

So as to discover the cause which encourages the generation of flaws over the entire surface of the material (hereinafter, referred to as "scale-like flaw".) and develop a countermeasures, the present inventors had intensively studied remained condition of the various elements in the duplex stainless steel test piece in the depth direction from the surface layer, wherein furnace temperature and holding duration of the test piece is varied. As a result, they have found out the fact that content of N (nitrogen) and B (boron) is related to the generation of scale-like flaw. The results are shown in Table 1.

The upper section of FIG. 1 shows a result of the research related to N. The test piece of which furnace temperature was high and of which in-furnace holding duration was long can be observed such that N content around the surface layer becomes higher than ladle analysis values. The lower section of FIG. 1 shows a result of the research related to B; in each test pieces, reduction of B content can be observed below ladle analysis values around the surface layer. Especially, in the test piece of which furnace temperature was high and of which in-furnace holding duration was long, reduction of B content can be observed even around the depth of 1.5 mm from the surface layer. According to these results, cause of generation of scale-like flaw is assumed to be nitriding and deboronation around vicinity of outer surface by heating of billet. In other words, $B_2O_3$ as an oxide of B is more stable than $Cr_2O_3$ as an oxide of Cr and has stability comparable to $SiO_2$ as an oxide of Si; thus, B is preferentially oxidized simultaneously with heating at high temperature so that B-absentee layer is generated. Quick diffusion of B allows this B-absentee layer to expand up to mm order. Due to the loss of B originally segregated along the grain boundary, segregation of S along the grain boundary becomes possible, which results in the grain boundary to become brittle. On the other hand, at the early stage of heating, $Cr_2O_3$ coating is formed to be a barrier, so that N in the atmosphere cannot easily infiltrate into the steel. However, when the coating is destroyed by heating over the temperature of 1200° C., nitriding becomes possible; thus, N is fused in austenite in a state of solid-solution, which results in expansion of difference between strength of austenite and that of ferrite. Therefore, together with the effect of grain boundary embrittlement attributed to the deboronation, workability is deteriorated, and generation of scale-like flaw is encouraged.

The present inventors studied based on the above knowledge; consequently, as a measure of scale-like flaw generation, they have discovered a method comprising the step of coating a lubricant on the surface of crude material before heating for preventing ambient air from contacting the surface of the crude material as much as possible in order to inhibit nitriding and deboronation of the surface of crude material. Hereinafter, the invention will be described.

The first aspect of the invention is a lubricant composition for hot metal working comprising a plurality of glass frits respectively having different softening point from each other so as to solve the above problems.

Here, the word "glass frit" of the invention means a glass produced by melting the raw material and quenching it in water or air, it is in general a cullet type or in powdered state.

Moreover, the expression "hot metal working" in the invention means an operation having the steps of: preheating a crude material up to a predetermined high-temperature; and thereafter, carrying out metal working by using e.g. processing machinery such as rolling mill, forging machine, and extruder while maintaining the temperature of the crude material at high. Therefore, the expression "hot metal working" of the invention is used as an idea including heating step of the crude material and step of metal working of the same.

The second aspect of the invention is the lubricant composition for hot metal working according to the first aspect of the invention, wherein among said plurality of glass frits, at least one glass frit has viscosity of $10^3$ to $10^6$ dPa·s at 1200° C., another one of glass frits has viscosity of $10^3$ to $10^6$ dPa·s at 700° C.

The third aspect of the invention is the lubricant composition for hot metal working according to the first or second aspect of the invention, wherein a component (hereinafter, referred to as "friction coefficient controlling agent") is contained in order to increase or decrease friction coefficient between a workpiece and tools during metal working.

The friction coefficient controlling agent acts as heat-resistant solid particles to prevent the material from directly contacting the tools and to inhibit increase of friction coefficient as a result of seizure. In addition, the friction coefficient controlling agent also functions as an antislipping agent; it secures appropriate friction coefficient to avoid roll-slippage. For instance, in the piercing-rolling step of pipe-production line, alumina, silica, and so on are dispersed in a predetermined medium and the dispersed medium is sometimes used as an antislipping agent.

The fourth aspect of the invention is the lubricant composition for hot metal working according to any one of first to third aspects of the invention, wherein a solid component and a liquid component at room temperature are contained and a dispersion-suspension agent is contained in the liquid component in which agent the solid component is dispersively suspended.

The expression "a solid component at room temperature" means a component among the above glass frit and friction coefficient controlling agent, these of which are solid at room temperature. On the other hand, the expression "a liquid component at room temperature" means, for example, water, solvent, and so on to be used for coating or spraying, on the surface of the crude material, a solid component at room temperature contained in the lubricant composition for hot metal working of the invention.

Further, the expression "dispersion-suspension agent" of the invention means a substance which has a function to disperse or suspend the powder component such as glass frit contained in the lubricant composition for hot metal working into the medium like water. Specific examples thereof include clay, inorganic powder like bentonite, and organic solvent such as acrylic acid ester.

The fifth aspect of the invention is a method of hot metal working comprising the step of coating the lubricant composition for hot metal working according to any one of first to fourth aspects of the invention on the surface of a crude material before heating, so as to solve the above problems.

Here, the word "crude material" in the present invention means a metal generally used for hot metal working.

The sixth aspect of the invention is a method for producing seamless pipe using the method of hot metal working according to the fifth aspect of the invention.

Effects of the Invention

According to the first aspect of the invention, since the lubricant composition for hot metal working contains a plurality of glass frits respectively having different softening point from each other, the lubricant is capable of maintaining appropriate viscosity corresponding to the different temperature range. So, in each step of the hot metal working (i.e. heating/soaking in the heating furnace, transferring from the heating furnace to the step of metal working, and the following (hot) metal working), sufficient coating can be formed on the surface of the billet/hollow shell and so on as a crude material. Accordingly, contact of ambient air to the surface of the crude material can be inhibited as much as possible; whereby generation of scale-like flaw can be inhibited.

If the lubricant composition for hot metal working only contains glass frit with low-softening point, the lubricant composition for hot metal working cannot secure adequate viscosity at high-temperature range; hence the lubricant composition for hot metal working come off from the surface of the crude material. Consequently, in case where temperature in the heating surface is set around the maximum temperature and at a time of metal working, ambient air cannot be prevented from contacting the surface layer of the crude material; thereby generation of scale-like flaw cannot be inhibited. Together with the lubricant, the friction coefficient controlling agent contained in the lubricant composition for hot metal working also come off. For instance, when the hot metal working is piercing-rolling of a billet, the billet and rolls cause a slippage which results in seizure between them, which is problematic.

On the other hand, when the lubricant composition for hot metal working only contains glass frit with high-softening point, the lubricant composition for hot metal working cannot prevent ambient air from contacting the surface of the crude material in the heating furnace, thus generation of scale-like flaw cannot be inhibited.

According to the second aspect of the invention, since at least one glass frit has viscosity of $10^3$ to $10^6$ dPa·s at 1200° C., even when the lubricant composition for hot metal working is exposed at high-temperature range, it can maintain appropriate viscosity thereby it does not come off from the surface of the crude material. Because of this, in case where temperature in the heating surface is set around the maximum temperature and at a time of metal working, the lubricant can prevent ambient air from contacting the surface layer of the crude material as much as possible, hence generation of scale-like flaw can be inhibited. Moreover, the friction coefficient controlling agent contained in the lubricant composition for hot metal working does not come off from the surface of the crude material.

Further, another one of glass frits has viscosity of $10^3$ to $10^6$ dPa·s at 700° C. so that lubricant soaks and spreads on the surface of the crude material sufficiently within the temperature range of heating furnace to coat the surface of the crude material; it is capable of preventing ambient air from contacting the surface of the crude material, thus generation of the scale-like flaw can be inhibited.

According to the third aspect of the invention, depending on the usage of the lubricant composition for hot metal working, by adding substance for lowering or raising the friction coefficient, the lubricant composition for hot metal working of the present invention can be broadly applied.

According to the fourth aspect of the invention, since solid component is dispersively suspended in the liquid, it is possible to coat or spray the lubricant composition for hot metal working having homogeneous properties on the surface of the crude material. Further, there is no need to provide stirrer to the reservoir tank of the lubricant composition for hot metal working. Still further, the dispersion-suspension agent has an advantage, in the coating operation at room temperature, of spreading the lubricant composition for hot metal working onto the surface of the crude material and preventing the lubricant composition from running off.

According to the fifth aspect of the invention, it is possible to provide a method of hot metal working, wherein during the hot metal working, contact of ambient air to the surface layer of the crude material is prevented as much as possible to inhibit generation of scale-like flaw.

According to the sixth aspect of the invention, it is possible to provide a method for producing seamless pipe, wherein during the heating in the furnace or piercing-rolling, contact of ambient air to the surface layer of the billet and/or hollow shell is prevented as much as possible to inhibit generation of scale-like flaw.

Such effects and advantages of the inventions will be made apparent from the best mode for carrying out the invention, which will be described as follows.

BEST MODE FOR CARRYING OUT THE INVENTION

Figure 1:
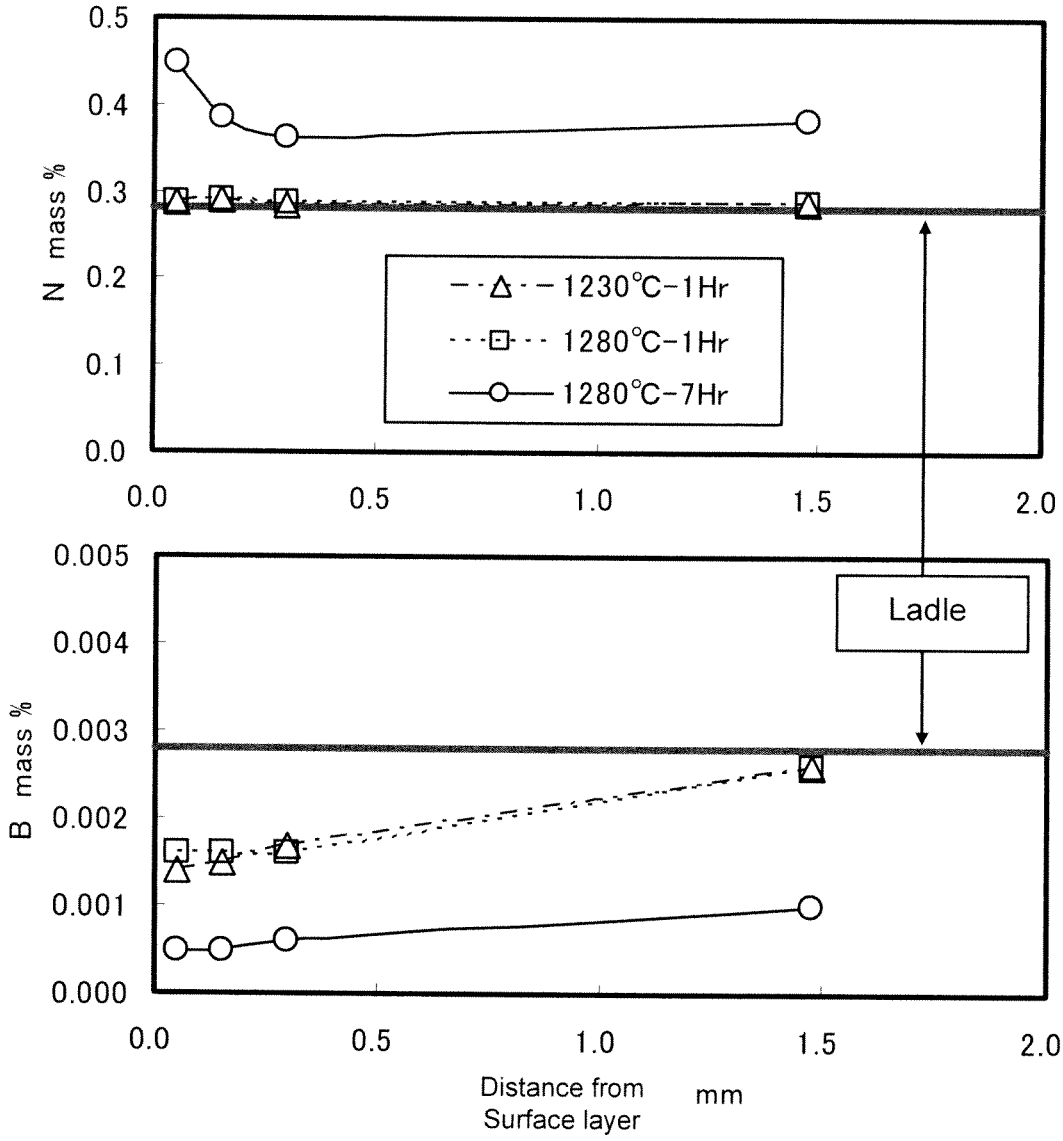
FIG. 1 is a graph showing a result of research related to the content of N (nitrogen) and B (boron) of a test piece of duplex stainless steel in the depth direction from the surface layer, in case where the furnace temperature and the holding duration thereof are varied.

The first mode of the present invention is a lubricant composition for hot metal working which comprises a plurality of glass frits respectively having different softening point from each other. The word "glass frit" means a kind of glass produced by the steps of: mixing individual glass component in advance and melting the mixture; and then quenching it in water or atmosphere. When an inorganic component is used as a glass frit, compared with a case where individual components are supplied as one of the components of the lubricant composition for hot metal working, melting point of the inorganic component is lowered from those of other individual components due to the preliminary melt-mixing and eutectic reaction caused thereby; thus the glass frit can stably exist as an anti-seizure agent. Moreover, in case where water and/or crystal water are included in each component, if individual components are as they are, the lubricant coating tends to be peeled due to boiling when heated; however, processing these individual components to a form of frit, there is no worry about peeling by boiling and so on.

Hereinafter, each component contained in the lubricant composition for hot metal working will be described.

(Glass Frit)

<First Glass Frit>

A first glass frit contained in the lubricant composition for hot metal working of the present invention is a glass frit having high-softening point. By the first glass frit, when temperature in the heating-soaking furnace is around maximum temperature (e.g. 1200 to 1300° C.) and when crude material is at high temperature due to heat generated from the hot metal working and friction heat, the lubricant has an appropriate viscosity; thereby it soaks and spreads all over the surface of the crude material. Therefore, at high temperature, since the lubricant coats the surface of the crude material, contact of the ambient air to the surface of the crude material can be inhibited as much as possible; thus, generation of scale-like flaw can be inhibited. Further, by the first glass frit, loss of below-described friction coefficient controlling agent from the surface of the crude material can be inhibited, so that the lubricant composition can maintain adequate lubrication state at a time of hot metal working.

In case where the above first glass frit is not contained in the lubricant composition for hot metal working of the invention, within the above high temperature range, the lubricant does not have viscosity necessary for adhering to the surface of the crude material. Because of this, the lubricant composition for hot metal working runs off from the surface of the crude material and thereby come off from the same, so that ambient air freely contacts to the surface of the crude material. In addition, the friction coefficient controlling agent contained in the lubricant composition for hot metal working also come off; hence the lubricant composition cannot realize the function which the present invention requires. For example, when the hot metal working is piercing-rolling for pipe production, during piercing-rolling, a billet and rolls skid each other that results in seizure between them; further, after piercing-rolling, scale-like flaws are generated on the surface of hollow shell.

Softening point of the first glass frit is not specifically limited to; the viscosity is preferably within the range of $10^3$ to $10^6$ dPa·s at 1200° C. The temperature "1200° C." is equivalent to maximum heating temperature during steel's hot metal working and the temperature of crude material during the metal working. By setting the lower limit of the viscosity to $10^3$ dPa·s, running off of the lubricant composition for hot metal working at high temperature from the surface of the crude material can be inhibited. On the other hand, by setting the upper limit of the viscosity to $10^6$ dPa·s, loss of the lubricant composition for hot metal working from the surface of the crude material at high temperature can be inhibited.

Average particle diameter of the first glass frit is not particularly restricted to; in order to make the first glass frit be dispersively suspended in the lubricant statically and stably during storage and in view of evenly coating to the surface of the crude material, the diameter is preferably 25 μm or less.

In the invention, material to form the first glass frit is not particularly limited to; the examples may include a glass frit which contains 60 to 70 mass % of $SiO_2$, 5 to 20 mass % of $Al_2O_3$, 0 to 20 mass % of CaO, as well as optionally contains MgO, ZnO, $K_2O$, and so on.

<Second Glass Frit>

The second glass frit contained in the lubricant composition for hot metal working of the present invention is a glass frit which has a lower softening point than that of the first glass frit. By the second glass frit, in case where the temperature in the heating-soaking furnace is relatively low (e.g. 400 to 800° C.), the lubricant has an adequate viscosity, which allow the lubricant to soak and spread all over the surface of the crude material. Hence, in the heating-soaking furnace, as the lubricant coats on the surface of the crude material, contact between the surface of the crude material and ambient air is restricted as much as possible, whereby generation of the scale-like flaw is inhibited.

When the above second glass frit is not contained in the lubricant composition for hot metal working of the invention, in the heating-soaking furnace, the lubricant cannot coat the surface of the crude material. Therefore, the above effect to prevent ambient air from contacting the surface of the crude material as much as possible cannot be obtained.

Softening point of the second glass frit is not particularly limited to; the viscosity is preferably within the range of $10^3$ to $10^6$ dPa·s at 700° C. The temperature "700° C." is assumed to be low to middle temperature range in the heating furnace for heating crude material. By setting lower limit of the viscosity to $10^3$ dPa·s, running off of the lubricant composition for hot metal working from the surface of the crude material can be inhibited in the heating-soaking furnace. Meanwhile, by setting upper limit of the viscosity to $10^6$ dPa·s, it is possible to inhibit loss of the lubricant composition for hot metal working in the heating-soaking furnace from the surface of the crude material.

Average particle diameter of the second glass frit is not particularly restricted to; in order to make the second glass frit be dispersively suspended in the lubricant statically and stably during storage and in view of evenly coating to the surface of the crude material, the diameter is preferably 25 μm or less.

In the invention, material to form the second glass frit is not particularly limited to; the examples may include a glass frit which contains 40 to 60 mass % of $SiO_2$, 0 to 10 mass % of $Al_2O_3$, 20 to 40 mass % of $B_2O_3$, 0 to 10 mass % of ZnO, 5 to 15 mass % of $Na_2O$, as well as optionally contains CaO, $K_2O$, and so on.

(Friction Coefficient Controlling Agent)

The friction coefficient controlling agent in the present invention is a component which is added to the lubricant composition for hot metal working, depending on the intended use of the lubricant composition for hot metal working, so as to increase or decrease the friction coefficient between the workpiece to be plastically worked and tools.

Examples of the component which raises friction coefficient of the lubricant composition for hot metal working may be alumina ($Al_2O_3$) and silica ($SiO_2$). Also, examples of the component which lowers friction coefficient of the lubricant composition for hot metal working may be the so-called "solid lubricant" having layer structure such as graphite and mica.

As the friction coefficient controlling agent of the invention is to adjust friction coefficient of the lubricant composition for hot metal working, normally, the expression "friction modifier" appropriately describes the nature of this additive component. However, the expression "friction modifier (FM)" has already been widely used to represent a general idea where is a lubricant additive substance (e.g. MoDTC as an organic metal series FM, ester amine having long-chain alkyl as an ashless FM, etc.) which lowers friction coefficient by adsorbing onto the metal surface and inhibiting direct contact between opposing metals. So, in this specification, the expression "friction coefficient controlling agent" is dare used. In addition to the idea of the above "friction modifier" used for the purpose of lowering friction coefficient between the workpiece and tools, the expression "friction coefficient controlling agent" in the present invention indicates a wide range of idea including: graphite used for the same purpose; solid lubricant having layer structure such as various mica; and further, powder to be used for raising friction coefficient between a workpiece and tools, such as alumina and silica.

(Dispersion-Suspension Agent)

The dispersion-suspension agent in the present invention is a substance which has a function to disperse or suspend powder component such as glass frit contained in the lubricant composition for hot metal working into medium like water. Specific examples include clay, inorganic powder like bentonite, and organic solvent like acrylic acid ester. In view of inhibiting generation of gas in the heating-soaking furnace, rather than using organic solvent, clay and inorganic powder like bentonite are preferably used.

The example of clay may be the one which contains about 55 mass % of $SiO_2$, about 30 mass % of $Al_2O_3$, about 11 mass % of Igloss, and optionally contains $Fe_2O_3$, CaO, MgO, $Na_2O$, $K_2O$, and so on as minor components. The example of bentonite may be the one which contains about 60 mass % of $SiO_2$, about 15 mass % of $Al_2O_3$, about 17 mass % of Igloss, and optionally contains $Fe_2O_3$, CaO, MgO, $Na_2O$, $K_2O$, and so on as minor components.

The lubricant composition for hot metal working of the invention can be evenly coated or sprayed on the surface of the crude material, since solid component is dispersively suspended in the liquid by the dispersion-suspension agent. Further, reservoir tank for preserving lubricant composition for hot metal working needs no stirrer. Still further, during the coating operation at room temperature, the dispersion-suspension agent allows the lubricant composition for hot metal working to spread onto the surface of the crude material and inhibits loss of the lubricant composition.

(Other Components)

To the lubricant composition for hot metal working of the present invention, in addition to the above described individual components, other optional components can be added depending on the intended uses. Specific examples of other components include: for improvement of coatability, various inorganic electrolyte such as 0.5 parts of sodium nitrite and viscosity adjuster such as organic binder; and inorganic compound for pH adjustment.

(Method of Hot Metal Working)

Figure 2:
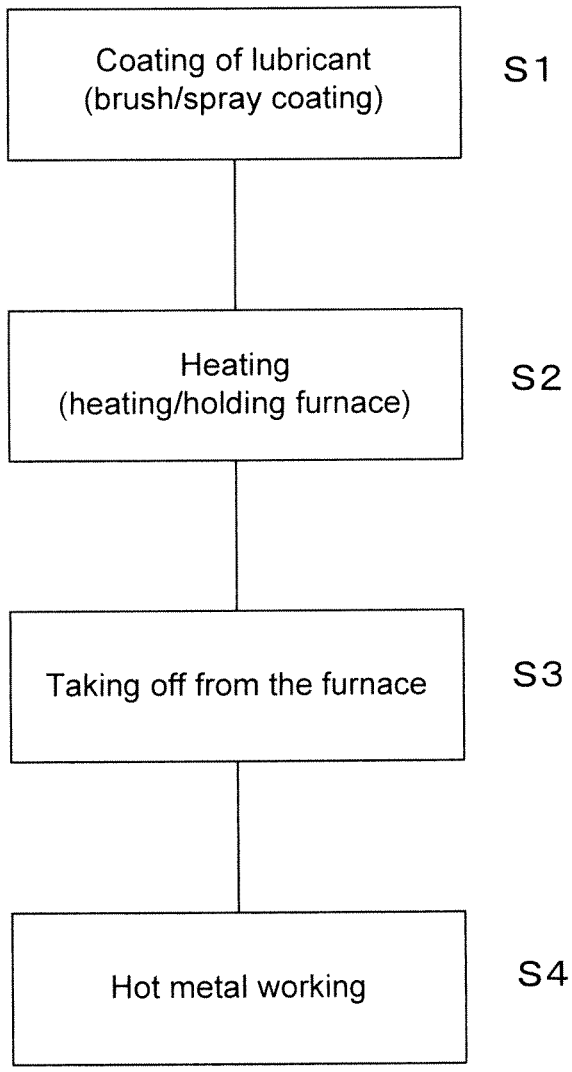
FIG. 2 is a flow chart showing an example for the method of hot metal working of the present invention.

The second mode of the present invention is a method of hot metal working which comprises the step of coating the above lubricant composition for hot metal working onto the surface of non-heated crude material. FIG. 2 shows a flow chart showing an example about the method of hot metal working of the present invention. In the first step S1, the surface of the crude material is evenly coated with the lubricant composition for hot metal working of the first mode of the invention by brush coating or spray coating. In the second step S2 to follow, the crude material on the surface of which is evenly coated with the above lubricant composition for hot metal working is fed into a heating furnace or soaking furnace and kept it at a predetermined temperature for a predetermined period. As required, heating-up period should be controlled. When the crude material is stainless steel or high-alloy steel, furnace maximum temperature is adjusted at a range between 1200 and 1300° C. Then, in the third step S3, the above crude material in the heating furnace or soaking furnace is taken out to plastically work the heated crude material in the following the fourth step S4.

The feature about the method of hot metal working of the second mode of the invention is, in the first step S1, to evenly coat the lubricant composition for hot metal working of the first mode of the invention onto the surface of the crude material. Moreover, by a plurality of glass frits contained in the lubricant composition for hot metal working and respectively having different softening point from each other, lubricant can maintain adequate viscosity despite of the temperature change through the second step S2 to the fourth step S4; by constantly coating the surface of the crude material, contact of the ambient air to the surface of the crude material can be inhibited as much as possible. In addition, due to the above coating, loss of the friction coefficient controlling agent contained in the lubricant composition for hot metal working can also be inhibited, in the step of hot metal working S4, the method can attain the effect where the present invention requires.

(Method for Producing Seamless Metal Pipe)

Third mode of the present invention is a method for producing a seamless pipe using the above method of hot metal working. First of all, a billet is provided, wherein the billet may be obtained by cutting a cast bar, the cross-section of which is circular, produced by continuous casting line into a predetermined length, or may be formed in a predetermined size of cylindrical shape by forging line.

To the surface of the billet of the first step S1, the lubricant composition for hot metal working is evenly coated; and then, heating of the billet is carried out in the heating furnace (or soaking furnace) for predetermined period (step S2). Following to that, the heated billet is taken out from the furnace (step S3), and the billet is treated with predetermined hot metal working by piercing-rolling mill to be a hollow shell. Later, the hollow shell becomes a finished seamless pipe through processes of drawing-rolling and sizing.

EXAMPLES

By using an actual production line of seamless pipe having a heating furnace and a piercing-rolling mill, evaluation test was carried out.

(1) Test Piece for Evaluation

Material: duplex stainless steel and high-Ni steel for oil well tubular (2) Heating Condition in the Furnace:

Duplex stainless steel: at 1280° C. for 4 hours

High-Ni steel for oil well tubular: at 1220° C. for 4 hours (3) Condition of Piercing-Rolling:

Billet's shape: 220 mm ϕ (outer diameter)

Shape after rolling: 245 mm ϕ (outer diameter)×20 mm (thickness)×8000 mm (length)

(4) Coating of lubricant: various lubricants for evaluation adjusted in accordance with the predetermined composition as shown in Table 1 were respectively evenly coated on each billet's surface before its heating. It should be noted that, in Table 1, "antislipping agent" means a component among friction coefficient controlling agents, which acts to increase friction coefficient; as a specific example thereof, a mixture of alumina and silica was used. Also, as a dispersion-suspension agent in Table 1, clay was used. A total mass of solid components as 60 parts by mass including antislipping agent, low-softening point glass frit, high-softening point glass frit, and dispersion-suspension agent was dispersively suspended in 40 parts by mass of water to make the total be 100 parts by mass, so as to compose a lubricant for evaluation.

(5) Evaluation item: presence or absence of roll-slippage at a time of piercing-rolling, seizure flaw after piercing-rolling, and scale-like flaw after piercing-rolling were evaluated. The lubricant which is judged as the one satisfying the available level for actual production line is indicated as "○", which is judged as the one not satisfying the available level for actual production line is indicated as "X".

The results are shown in Table 1.

TABLE 1

| | Components of the Lubricant composition for hot metal working | | | | | Evaluation | | |
|---|---|---|---|---|---|---|---|---|
| | Friction coefficient controlling agent | Low-softening glass frit | High-softening glass frit | Dispersion-suspension agent | Water | Roll-slippage | Seizure flaw | Scale-like flaw |
| Example | ○ | ○ | ○ | ○ | ○ | ○ | ○ | ○ |
| Comparative example 1 | ○ | ○ | — | ○ | ○ | Rolling impossible | Evaluation impossible | Evaluation impossible |
| Comparative example 2 | ○ | — | ○ | ○ | ○ | ○ | ○ | X |
| Comparative example 3 | No coating of the lubricant composition | | | | | ○ | X | Observation impossible |

According to the Examples, the following points become apparent.

When a lubricant in which glass frit consisting of low-softening point only was mixed was used (Comparative example 1), and when temperature in the heating furnace became the maximum temperature range (1200 to 1300° C.), glass frit in the lubricant was melted. In such a circumstance, viscosity of the lubricant is extremely low, so the lubricant runs off from the surface of the billet, and the friction coefficient controlling agent such as alumina contained in the lubricant simultaneously came off from the surface of the billet. As a result, since no effective lubricant was left on the billet surface at the time of following piercing-rolling, rolls and a billet are skid each other whereby piercing-rolling is assumed to become impossible.

On the other hand, when another lubricant in which glass frit consisting of high-softening point only was mixed was used (Comparative example 2), due to the function of suspension agent, although solid portion (powder component: friction coefficient controlling agent) in the lubricant adhered to the surface of the billet, within low to middle temperature range in the furnace, the lubricant did not have sufficient viscosity, so that no coating can be formed on the billet surface. Hence, it is assumed that in the meanwhile ambient air freely contacts the billet surface thereby scale-like flaws are generated.

In case where a billet was fed into the heating furnace without coating of the lubricant thereon, and thereafter, piercing-rolling was carried out (Comparative example 3); although no roll-slippage was observed at a time of piercing-rolling, seizure flaw which is difficult to remove was observed. If the lubricant is not used, during piercing-rolling, particularly disk rolls and circumferential surface of the hollow shell are severely seized; thus it is assumed that flaws which are difficult to remove are generated.

On the other hand, when the lubricant of the present invention in which low-softening point and high-softening point glass frits were mixed was used, lubricant can have adequate viscosity by low-softening point glass frit within low to middle temperature range in the heating furnace, the lubricant was coated on the billet surface to inhibit contact of ambient air to the billet surface as much as possible. Further, within high-temperature range in the heating furnace and in the following piercing-rolling, the lubricant can maintains adequate viscosity by high-softening point glass frit and the lubricant was coated on the surface of the billet/hollow shell to inhibit contact of ambient air to the billet surface as much as possible. This is how generation of scale-like flaw can be inhibited. Still further, low-softening point glass frit or high-softening point glass frit was sequentially melted corresponding to each temperature range so that friction coefficient controlling agent in the lubricant did not come off from the billet surface. Consequently, no roll-slippage during piercing-rolling was caused, no seizure between guide rolls and billet/hollow shell was caused, either.

The above has described the present invention associated with the most practical and preferred embodiments thereof. However, the invention is not limited to the embodiments disclosed in the specification. Thus, the invention can be appropriately varied as long as the variation is not contrary to the subject substance and conception of the invention which can be read out from the claims and the whole contents of the specification. It should be understood that the lubricant composition for hot metal working and method of hot metal working using the same with such an alternation are included in the technical scope of the invention.

The invention claimed is:

1. A lubricant composition for hot metal working of a billet by piercing-rolling mill, the lubricant composition comprising:

(1) water;

(2) a first glass frit having viscosity of $10^3$ to $10^6$ dPa·s at 1200° C. and containing 60 to 70 mass % of $SiO_2$, 5 to 20 mass % of $Al_2O_3$, 0 to 20 mass % of CaO;

(3) a second glass frit having viscosity of $10^3$ to $10^6$ dPa·s at 700° C. and containing 40 to 60 mass % of $SiO_2$, 0 to 10 mass % of $Al_2O_3$, 20 to 40 mass % $B_2O_3$, 0 to 10 mass % of ZnO, 5 to 15 mass % of $Na_2O$;

(4) an anti-slipping agent comprising alumina or silica to increase a friction coefficient between the billet and a roll of the piercing-rolling mill;

(5) a dispersion-suspension agent to dispersively suspend a solid component including the glass frit and the anti-slipping agent in the water wherein said first and second glass frits respectively have different softening points from each other.

2. The lubricant composition according to claim 1, wherein the dispersion-suspension agent comprises clay or bentonite.

3. A method for producing seamless pipe, the method comprising steps of:

providing a billet;

coating, onto the surface of the billet, the lubricant composition according to claim 1;

heating the billet after coating the lubricant composition;

producing a hollow shell by piercing-rolling of the billet; and drawing-rolling and sizing the hollow shell.

* * * * *